US006197368B1

(12) United States Patent
Valenti et al.

(10) Patent No.: US 6,197,368 B1
(45) Date of Patent: Mar. 6, 2001

(54) PARTICULATE COATING APPARATUS AND METHOD

(75) Inventors: James P. Valenti, Lititz, PA (US); Edward M. Kohl, Newark, DE (US)

(73) Assignee: Armstrong World Industries, Inc., Lancaster, PA (US)

( * ) Notice: Subject to any disclaimer, the term of this patent is extended or adjusted under 35 U.S.C. 154(b) by 0 days.

(21) Appl. No.: 09/348,706

(22) Filed: Jul. 7, 1999

(51) Int. Cl.[7] ..... B05D 1/12

(52) U.S. Cl. ..... 427/202; 427/242; 118/308; 118/312

(58) Field of Search ..... 427/186, 188, 427/202, 197, 261, 286, 8, 242; 118/308, 312, 669, 672, 417–419, 674, 19, 30

(56) References Cited

U.S. PATENT DOCUMENTS 2,219,853 * 10/1940 Tone .
4,405,657 9/1983 Miller, Jr. et al. ..... 427/54.1
4,530,856 7/1985 Kauffman et al. ..... 427/197
4,547,245 10/1985 Colyer ..... 156/220
4,761,306 8/1988 Clark et al. ..... 427/197
5,011,709 * 4/1991 Arbogost et al. .
5,728,216 * 3/1998 London .

* cited by examiner

*Primary Examiner*—Fred J. Parker

(57) ABSTRACT

The disclosure is for an apparatus and a method of adhering particulate matter to limited areas of adhesive on a moving web and enabling the use of a very limited amount of particulate matter so that material costs are minimized. The path of a moving web with zones of adhesive and with previously supplied loose particles is shaped to form a trough with substantially vertical sides, so that gravity clears the web of excess material as the web moves down and up through the trough. Meanwhile, the particles falling from the web, go into the bottom of the trough where they stay until they stick to a following portion of the web which has adhesive. The loose particles are thereby immediately recycled for use, without any exposure to other contaminating materials, and the amount of particulate material used approaches the ideal quantity which would be needed to cover only the adhesive areas.

16 Claims, 1 Drawing Sheet

PARTICULATE COATING APPARATUS AND METHOD

BACKGROUND OF THE INVENTION

This patent deals generally with material coating, and more specifically with an apparatus and a method for coating limited areas of a moving web with particulate matter.

One type of product in the flooring industry requires the application of particle such as different colored vinyl particles on sheet material to create a pattern. This is accomplished by first applying a pattern of adhesive to the sheet material, and then covering the adhesive with the particles which are to be attached to the sheet. This application of particles has typically involved covering the entire sheet with particles to a uniform depth, and then removing all the loose particles, i.e. those which have not adhered to the adhesive pattern. In many circumstances this can entail supplying five times the amount of particles that are actually needed, and, of course, removing 80% of the particles from the sheet material before subsequent processing.

The removal of such a large quantity of particles is a major task. It usually involves blowing high pressure, high volume air against the sheet to dislodge the loose particles and simultaneously using a large vacuum pickup to remove the particles from the sheet. These processes are both performed on a continuous, fast moving, wide width sheet, which requires air supply and vacuum pickup fixtures which span the entire width of the sheet and can handle very large volumes.

Moreover, because of the large excess used, the loose particles removed from the sheet must be recycled. This recycling can then be the source of contamination of the particles by dirt, moisture, adhesive, and other foreign matter, and such contamination can cause separation of the components in the particles. The particles used are frequently actually a mix of different colors and textures, and any contamination or separation can cause inconsistent and unacceptable final product.

It would be very advantageous to have a means for adhering particles to a moving sheet which did not involve the application of a quantity of particles which greatly exceeded the amount actually remaining on the sheet. It would be particularly beneficial if any excess of particles applied to the sheet were so small that there would be no need to recycle the excess or that contamination of the applied particles from the small amount of recycled material would be minimized.

SUMMARY OF THE INVENTION

The invention is an apparatus and a method of adhering particles to limited areas of adhesive on a moving web while using a very limited amount of particulate matter so that material costs are minimized. As in conventional systems, a limited pattern of adhesive is first applied to a wide width moving sheet, and the sheet is then coated with loose particles.

However, the present invention applies a much smaller quantity of the particulate matter onto the moving web of sheet material than has previously been used. In fact, the quantity of particles deposited upon the moving web need only be slightly greater than the quantity needed to exactly cover the adhesive coated areas. Experimentation has shown that the excess quantity used can be less than five percent.

This limited quantity of particles is made to serve the same purpose as the great excess of material in the prior art systems by the unique construction of the travel path of the web.

Although other processing makes it advantageous to have the web enter and leave the particle coating station in a horizontal plane, in the present invention the web path is built to dip down to form a significantly deep trough with vertical or substantially vertical input and output sides. The moving web then is cleared of excess material which has not adhered to the adhesive because gravity acts on the loose particles as the web moves down and then up through the trough. Furthermore, the particles falling from the web, fall to the bottom of the trough where they are distributed over the entire width by the motion of the web, and the particles stay in the trough until they stick to the adhesive applied to a following portion of the web.

The loose particles are thereby retained in the trough and immediately recycled for use, without any exposure to other contaminating materials, and the amount of particulate material used approaches the ideal quantity which would be needed to cover only the adhesive areas. The effect of the invention is essentially to move the sheet of material with adhesive upon it through a trough full of particles, except the trough is formed by the sheet itself.

To control the depth of the trough in the web, vacuum rollers are located separated from each other by enough distance to determine the span, the open space, across the trough. The speeds of the two rollers are then automatically controlled using a position sensor located under the trough to regulate the working depth of the trough.

It is sometimes advantageous to use a low pressure, low volume air source to aid in dislodging any loose material from the moving web as the the web turns the corner from the substantially vertical output path of the trough to the following horizontal path. This air source also helps to agitate the particles within the trough so that they are distributed throughout the width of the web.

A small vacuum pickup fixture on the following horizontal path can also be used to clean the last remnants of any particles not adhering to the adhesive.

The present invention thereby produces patterns of coating on sheet material without the use of a great excess of particulate matter, and uses so little particulate material that it can be practical to eliminate recycling of the excess. However, if recycling is desired, it is much easier because the quantity handled is so much less, and the problems of the recycled material affecting the new material are greatly reduced.

Furthermore, the reduction of particulate material handled, less than twenty percent of the previous amount used, can also permit higher production speeds.

BRIEF DESCRIPTION OF THE DRAWING

The FIGURE is a schematic drawing of the preferred embodiment of the invention.

DETAILED DESCRIPTION OF THE INVENTION

Figure 1:
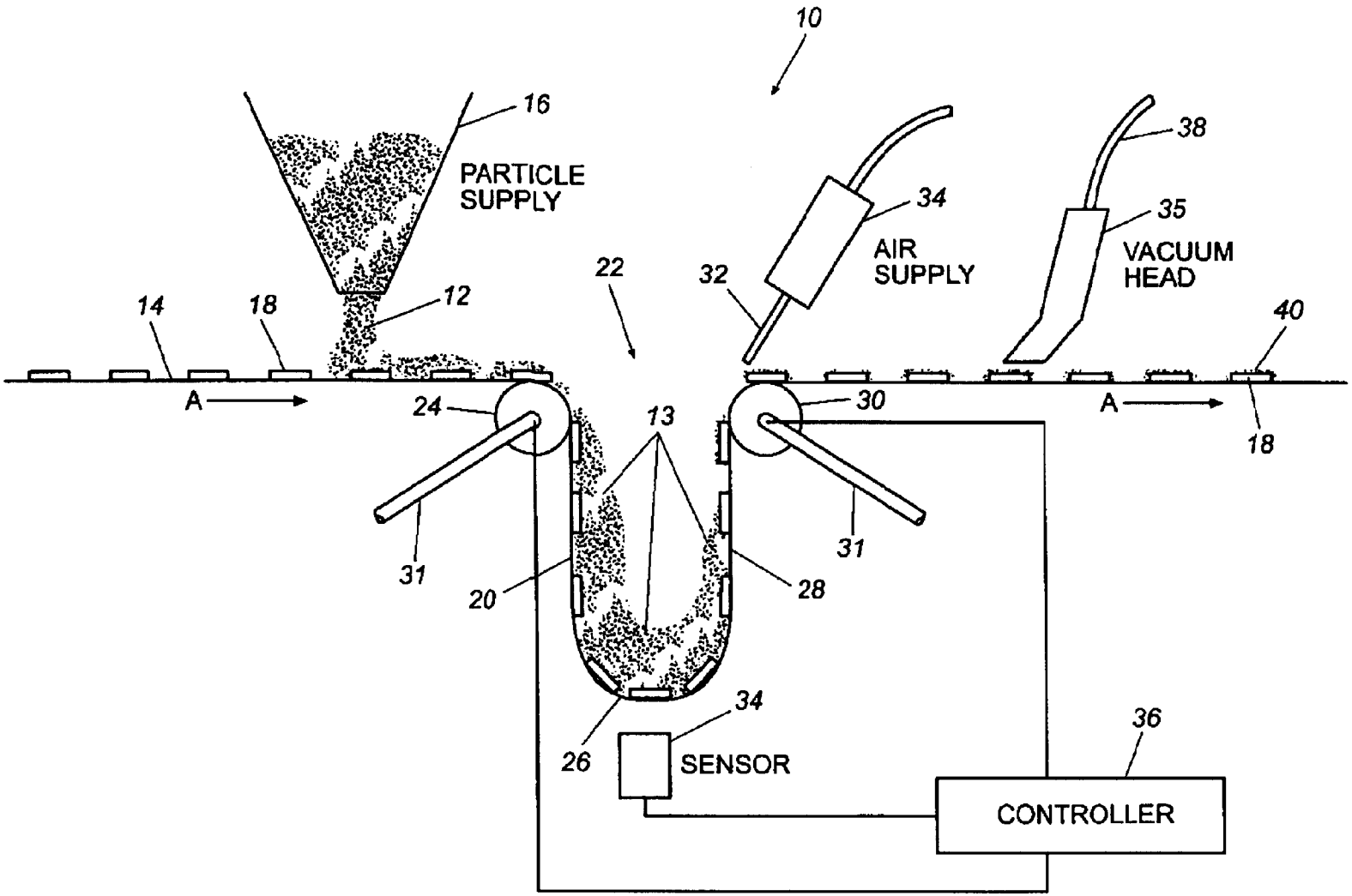

The FIGURE is a schematic drawing of the preferred embodiment of the invention in which particulate coating apparatus 10 attaches loose particles 12 to web 14 which is moving in the direction indicated by arrows A. Coating apparatus 10 functions in a manner which permits the quantity of loose particles 12 delivered from particle supply 16 to web 14 to be limited to a quantity only very slightly in excess of the ideal amount to cover the limited areas of web 14 to be covered.

The areas to be coated with particles 12 are determined by first applying a pattern of adhesive to web 14 which creates adhesive zones 18 to which loose particles 12 will adhere. This application of adhesive patterns is part of the prior art process and is well understood by those knowledgeable in the art. It is essentially because of the processes such as the preceding adhesive coating and the following finishing operations that it is desirable to move web 14 in approximately a horizontal plane. Coating apparatus 10 modifies this movement in a horizontal plane during the coating and adhesion processes but maintains the horizontal orientation at its input and output location.

In the preferred embodiment of the invention, after particle supply 16 delivers particles 12 upstream, the path of web 14 is diverted from the horizontal input path to vertical or substantially vertical input path 20 as web 14 enters trough 22. Trough 22 acts essentially as a distribution and recycling region. As web 14 moves over input roller 24 and down vertical path 20, unattached particles 13, those particles not adhering to adhesive zones 18, fall to bottom 26 of trough 22 and accumulate there unless they come in contact with other uncovered adhesive zones 18. Any additional unattached particles 13 which still remain on web 14 after web 14 moves out of trough bottom 26, also fall from web 14 and back into trough bottom 26 as web 14 travels up vertical or substantially vertical output path 28 and around output roller 30.

In some applications it is advantageous to encourage the dislodging of unattached particles 13 by the use of air nozzle 32 which receives air from air supply 34 that can be either an air compressor or a pressure tank with a remote air source (not shown). Air nozzle 32 furnishes the additional advantage of agitating unattached particles 13 within trough 22 to better assure an even distribution across the width of web 14.

Vacuum head 35 is another optional accessory that can also be used with web 14 to assure the removal of any remaining unattached particles. Particles captured by vacuum head 35, which is located downstream from trough 22, are moved to a remote location through vacuum line 38, and they can either be disposed of or recycled into particle supply 16. However, as long as particle coating apparatus 10 is operating properly, there is little economic benefit gained from recycling the small quantity of particles which are captured by vacuum head 35.

It should be appreciated that all the devices associated with web 14, such as particle supply 16, air nozzle 32, and vacuum head 35, extend over the entire width of web 14, either because there are multiple units used to affect the entire width, or because a single unit is constructed with a discharge or pick up opening which extends over the entire width of web 14.

It is advantageous under some circumstances to maintain accurate control of the depth of trough 22, and that can be accomplished by the use of a feedback system to control the speeds of input roller 24 and output roller 30. For the use of such a control system is desirable to use vacuum rollers for input roller 24 and output roller 30.

Vacuum rollers are conventional devices in industry. They are constructed with multiple surfaces holes with the holes in certain locations during roller rotation selectively interconnected with a vacuum system through a rotary coupling to the roller. Thus, in the present invention the holes on the roller surfaces which are in contact with web 14 have a vacuum drawn on them by means of vacuum lines 31 which are connected to a vacuum source (not shown), and the vacuum holds the web tightly against the rollers to prevent the web from slipping on the rollers.

This tight contact between the web and the rollers then makes it possible to increase or decrease the depth of trough 22 by varying the relative speeds of the rollers. If, for example, trough 22 has increased in depth, bottom 26 approaches closer to sensor 34, which may be an ultrasonic, infrared, or even a mechanical sensor. Once controller 36, which is interconnected to sensor 34, interprets the reading from sensor 34, controller 36, which is interconnected to at least one roller's speed control, slows the speed of input roller 24 or increases the speed of output roller 30 until bottom 26 of trough 22 has reached a proper position as indicated by sensor 34. A similar but opposite action takes place if bottom 26 of trough 22 is detected to have moved away from sensor 34. The depth of trough 22 can thereby be maintained to very close tolerances.

The present invention thereby deposits a precise amount of particles 40 onto adhesive zones 18 with very little excess use of loose particles 12 and with virtually no loose particles left on web 14 to affect subsequent processing.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, the invention can be used with or without air nozzle 32 and vacuum head 35, and particle supply can be located anywhere along web 14 before or at trough 22.

What is claimed as new and for which Letters Patent of the United States are desired to be secured is:

1. In a particulate coating apparatus wherein the top surface of a moving web has preapplied zones of adhesive covering parts of the top surface of the web and has particles delivered from a particle supply to the top surface of the web in a quantity at least enough to cover the zones of adhesive so that the particles adhere to the adhesive zones on the web and do not adhere to portions of the web without adhesive, the improvement comprising:

a trough formed in the moving web between input and output rollers over which the web moves, with the trough located on a part of the web which has particles on it, the trough including an input path where the web moves down into the trough after moving over the input roller and an output path where the web moves up and out of the trough before moving over the output roller, with the input path and the output path connected by a trough bottom, and with the input and output paths oriented so that particles not attached to adhesive zones fall from the input path and the output path into the bottom of the trough where the unattached particles contact and adhere to the adhesive zones on the web as the adhesive zones move through the trough.

2. The particulate coating apparatus of claim 1 wherein the input and output paths are located in substantially vertical planes.

3. The particulate coating apparatus of claim 1 wherein the particle supply delivers particles to the web upstream from the trough.

4. The particulate coating apparatus of claim 1 wherein the axis of rotation of the input roller and the axis of rotation of output roller are stationary.

5. The particulate coating apparatus of claim 1 wherein the input and output rollers are vacuum rollers.

6. The particulate coating apparatus of claim 1 further including an air nozzle located above the trough and supplying air to help dislodge unattached particles from the web.

7. The particulate coating apparatus of claim 1 further including an air nozzle located above the trough and supplying air to help distribute unattached particles through out the bottom of the trough.

8. The particulate coating apparatus of claim 1 further including a vacuum head located adjacent to the web downstream from the trough to collect unattached particles.

9. The particulate coating apparatus of claim 1 further including a sensor determining the location of the bottom of the trough and a controller interconnected to the sensor and controlling the speed of the web at least upstream or downstream of the trough, so that the bottom of the trough can be raised and lowered by varying the relative speeds of portions of the web upstream and downstream of the trough.

10. The particulate coating apparatus of claim 1 further including a sensor determining the location of the bottom of the trough and a controller interconnected to the sensor and also interconnected to and controlling the speed of rotation of at least one of the input and output rollers, so that the bottom of the trough can be raised and lowered by varying the relative speeds of the rollers.

11. A method of coating a moving web with particles comprising:

coating parts of a moving web with zones of adhesive;

delivering particles to the top surface of the web in a quantity at least enough to cover the zones of adhesive;

forming a trough in a part of the moving web between input and output rollers over which the web moves, with the trough located at a part of the web which has particles on it, the trough including an input path where the web moves down into the trough after moving over the input roller and an output path where the web moves up and out of the trough before moving over the output roller, with the input and output paths connected by a trough bottom, and with the input and output paths oriented so that particles not attached to adhesive zones fall from the input path and the output path into the bottom of the trough where the unattached particles contact and adhere to the adhesive zones on the web as the adhesive zones move through the trough.

12. The method of claim 11 further including supplying air to the trough to help dislodge unattached particles from the web.

13. The method of claim 11 further including supplying air to the trough to help distribute unattached particles through out the bottom of the trough.

14. The method of claim 11 further including supplying a vacuum adjacent to the web downstream from the trough to collect unattached particles.

15. The method of claim 11 further including using a sensor to determine the location of the bottom of the trough and a controller interconnected to the sensor for controlling the speed of rotation of at least one of the input and output rollers, so that the bottom of the trough can be raised and lowered by varying the relative speeds of rotation of the rollers.

16. The method of claim 11 further including using a sensor to determine the location of the bottom of the trough and a controller interconnected to the sensor to control the speed of the web at least upstream or downstream of the trough, so that the bottom of the trough can be raised and lowered by varying the relative speeds of portions of the web upstream and downstream of the trough.

* * * * *